US005183002A

United States Patent [19]

Parker

[11] Patent Number: 5,183,002

[45] Date of Patent: Feb. 2, 1993

[54] FOLDING AND NESTING BOAT

[76] Inventor: Corvin L. Parker, 5824 Urdea Rd., Jupiter, Fla. 33458

[21] Appl. No.: 835,353

[22] Filed: Feb. 14, 1992

[51] Int. Cl.[5] ..... B63B 3/00
[52] U.S. Cl. ..... 114/353
[58] Field of Search ..... 114/352-354, 114/344

[56] References Cited

U.S. PATENT DOCUMENTS

| | | | |
|---|---|---|---|
| 2,650,376 | 9/1953 | Sommer | 114/352 |
| 3,684,139 | 8/1972 | Johnson | 224/42.01 |
| 3,724,011 | 4/1973 | Scholle | 9/2 F |
| 3,822,427 | 7/1974 | Ewart | 9/25 |
| 3,996,635 | 12/1976 | Wilkes | 114/352 |
| 4,794,876 | 1/1989 | Levine | 114/352 |
| 4,827,865 | 5/1989 | Yelderman | 114/353 |
| 4,841,900 | 6/1989 | Maselko | 114/353 |
| 5,052,324 | 10/1991 | Lesly | 114/353 |

FOREIGN PATENT DOCUMENTS 2540932 3/1977 Fed. Rep. of Germany ..... 114/352

*Primary Examiner*—Jesûs D. Sotelo
*Attorney, Agent, or Firm*—Alvin S. Blum

[57] ABSTRACT

A boat is provided that has two configurations, a package configuration in which the boat is folded and nested into a compact package for transport and storage and a boat configuration in which the device is assembled into a rigid boat for operative use. The boat is separable into two or more transverse sections. Each section is divided into a port and a starboard portion which hingedly fold together to reduce the package width. The folded sections nest within one another to reduce the package length. The package configuration thereby has a shorter length and width than the boat configuration. Fastening devices are provided for securing the unfolded portions and sections together to provide a solid structure in the boat configuration.

15 Claims, 2 Drawing Sheets

FOLDING AND NESTING BOAT

BACKGROUND OF THE INVENTION

This invention relates to small boats and more particularly to boats which fold and in which certain folded parts nest within other parts for compact transport and storage.

Folding boats are well known in the small boat art. Some of the prior art boats include U.S. Pat. No. 5,052,324 to Lesly which sets forth a multipontoon boat in which the pontoons pivot relative to one another to reduce the overall width.

U.S. Pat. Nos. 3,684,139 to Johnson; 4,841,900 to Maselko; 4,827,865 to Yelderman; 3,724,011 to Scholle are exemplary of rigid boat sections hinged together so that the bow folds over the stern. These reduce the length by half, but the width remains unchanged.

U.S. Pat. Nos. 3,822,427 to Ewart and 3,996,635 to Wilkes both teach dividing the boat transversely into multiple rigid sections which nest together to further shorten the length of the boat. These do not however, reduce the width of the collapsed boat. A great reduction in both width and length of a boat for storage is desirable. This may be accomplished by use of inflatable construction. However inflated boats do not have the rigidity and fine lines often desired in a small boat.

SUMMARY OF THE INVENTION

It is accordingly an object of the invention to provide a boat that has rigid surfaces and fine lines when open and that is composed of rigid sections that fold and nest together so that both the overall width and length of the closed boat are thereby greatly reduced for transport and storage. It is a further object of the invention that the boat be readily converted between closed and open conditions with special skills. It is yet another object of the invention that the open condition provide a rigid boat with good operating characteristics.

The folding and nesting boat of the invention comprises an elongate boat divided transversely into at least two separable sections each section is divided into a port and a starboard portion that are permanently hinged to one another so that they may be folded together to thereby reduce the overall width by about half. The folded, separated sections are arranged to nest together in the folded state to thereby reduce the overall length by about half when there are two separable sections and by even a greater amount when there are more than two separated sections. Joining means are provided to join the unfolded sections together to provide a water-tight, rigid boat in the open condition.

These and other objects, advantages and features of the invention will become more apparent when the detailed description is considered in conjunction with the drawings, in which:

DETAILED DESCRIPTION OF PREFERRED EMBODIMENTS

Figure 9:
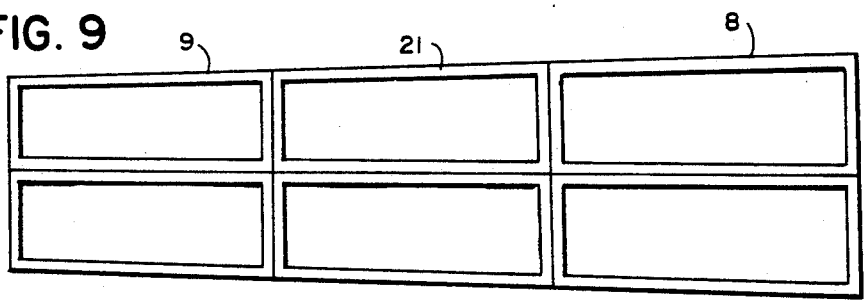
FIG. 9 is a top plan view of an another embodiment of the invention with an intermediate section.

Referring now first to FIGS. 1–4, the boat 1 is shown in the operational or boat configuration ready for use. It has rigid sides 5, transom 4, bow 3 and bottom 2. Its length, along centerline 17 is considerably greater than its beam or width. The boat is held together by bolts 18 in bolt holes 16. When the bolts are removed, the boat is separable into a stern section 8 and a bow section 9. Each section is provided with a transverse bulkhead 15 which are butted against each other and bolted together by bolts 18 to make a secure connection between the two sections.

The bow section 9 is comprised of a port portion 12 and a starboard portion 13 which are hinged together by hinges 6 for pivoting to a compact folded condition about a common pivot axis 7 as desired. The stern section 8 is comprised of a port portion 10 and a starboard section 11 which are hinged together by hinges 6 for pivoting to a compact folded condition about a common pivot axis 7. The port and starboard portions of a section are each provided with longitudinal bulkheads 14 which are butted against each other in the unfolded condition and secured in that position by bolts 18 in bolt holes 16. The bulkheads, sides, and portions of either transom or bow are joined together in water-tight connection to the bottom portion to form a rigid, strong structure with a water-tight periphery, and resilient gaskets 19 are provided to render the assembly water-tight when connected in the operational or boat configuration.

Figure 10:
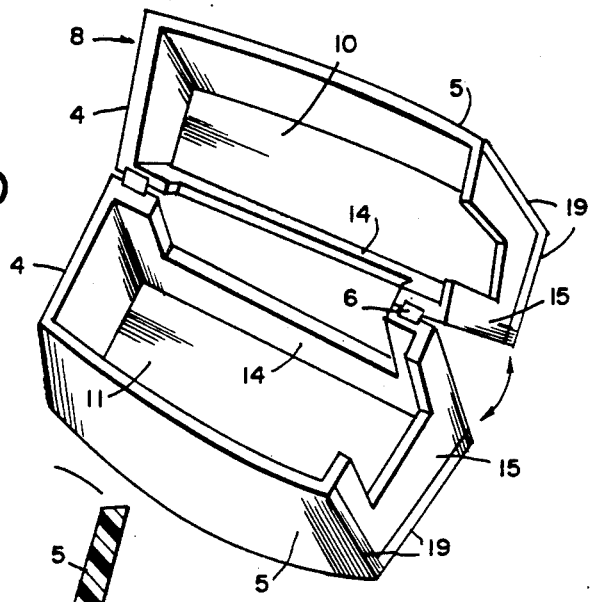
FIG. 10 is a perspective view of the partially folded stern section of FIG. 1.
Figure 4:
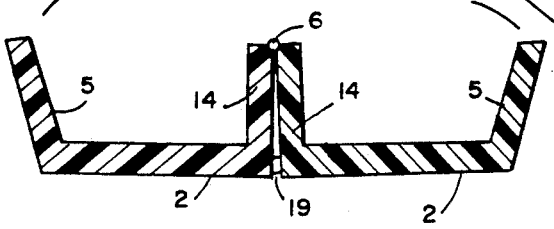
FIG. 4 is a sectional view taken through line 4—4 of FIG. 1.
Figure 3:
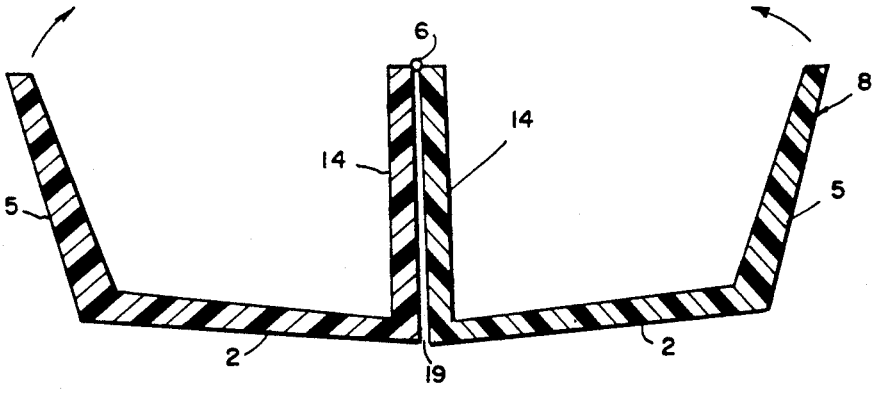
FIG. 3 is a sectional view taken through line 3—3 of FIG. 1.
Figure 6:
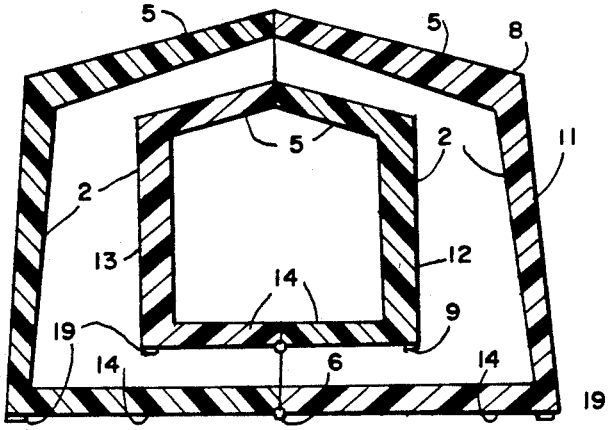
FIG. 6 is a sectional view taken through line 6—6 of FIG. 5.
Figure 5:
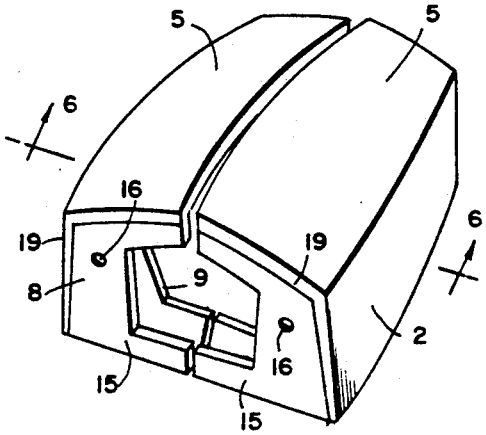
FIG. 5 is a perspective view of the boat in compact configuration.

When the bolts 18 are removed, the bow and stern sections may be separated from one another, and the port portion of each section is foldable over the starboard portion. For conversion to the compact or package configuration in which both the overall length and width are greatly reduced, the bow section is removed, reversed, and positioned on the stern section as shown in phantom as 20 in FIG. 1, then both sections are folded as shown in FIGS. 6 and 10. As they fold, the bow section 9 will nest into the stern section 8 until they are both completely folded as shown in FIG. 5 with the folded bow section 9 completely enclosed within the folded stern section 8. In the compact and well protected package configuration, the boat may be readily transported and stored.

As shown in FIG. 9, the overall length may be reduced even more in the package configuration when the boat is separable into a bow section 9, a stern section 8, and one or more intermediate sections 21, all of which fold and nest together.

Figure 8:
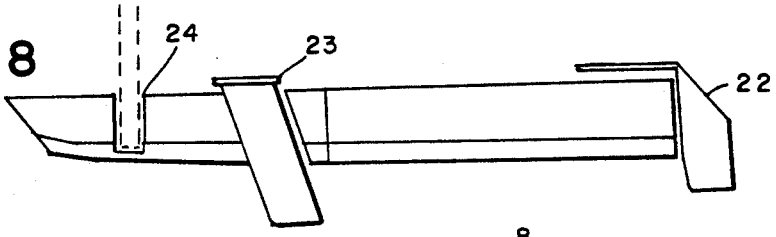
FIG. 8 is a sectional view taken on line 8—8 of FIG. 7.
Figure 7:
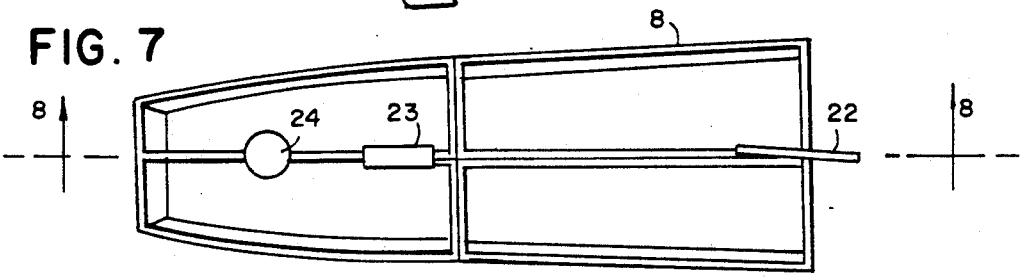
FIG. 7 is a top plan view of a sailboat of the invention ready for operation.
Figure 2:
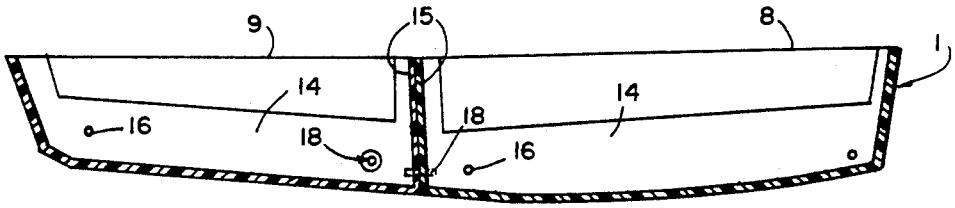
FIG. 2 is a sectional view taken through line 2—2 of FIG. 1.

FIGS. 7 and 8 show a sailboat embodiment of the invention in which supports are provided at the centerline for a rudder 22, a centerboard or daggerboard 23, and a mast 24 connected to one or both portions of a respective section.

Figure 1:
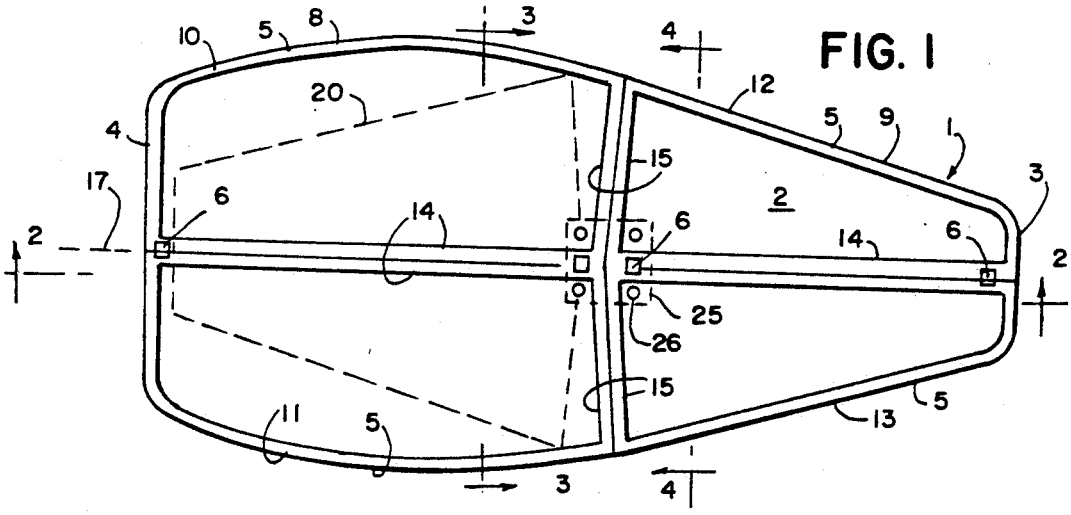
FIG. 1 is a top plan view of a boat of the invention ready for operation.

A combination seat and connector 25 is arranged to rest upon the junction of two sections at the midline as seen in FIG. 1. From a horizontal seat portion 25, four vertical members 26 depend and fit snugly at the junctions of the bulkheads to stablize the seat and further hold the assembly together.

The boat hull is preferably fabricated of closed cell foam sandwich with reinforced plastic facing well known in the art.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A boat having an open condition for operation and a folded and nested closed condition for transport and storage, said boat comprising:

A) a boat hull having rigid sides, a substantial length along a centerline, and a width less than said length when said boat is in an open condition;

B) said hull being divided into a plurality of separate transverse sections by at least one separation plane, said at least one separate plane being disposed transverse to said centerline;

C) each said transverse section being divided into a separate, rigid, port portion and a separate, rigid, starboard portion, each said portion having at least one rigid side and a bottom;

D) hinge means pivotally joining each said port portion to a corresponding said starboard portion for pivoting about a pivot axis that extends along said centerline, wherein said port portion is foldable against said starboard portion to yield a width substantially less than the width thereof when in open, unfolded condition;

E) said transverse sections being constructed so that said transverse sections, when folded, are nestable together within one another to provide a total closed package of said hull when in said closed condition that has an overall length and width that are both substantially less than the length and width of said hull when in said open condition; and F) fastening means for securing said port and starboard portions together in unfolded condition and for securing said sections together in open condition to thereby provide a rigid hull.

2. The boat according to claim 1, in which there are two transverse sections, a bow section and a stern section and said bow section, when folded, nests inside said stern section when folded.

3. The boat according to claim 1, in which there are three transverse sections, a bow section, a middle section, and a stern section.

4. The boat according to claim 3, in which said stern section fits into said bow section and said bow section fits into said middle section.

5. The boat according to claim 3, in which said bow section fits into said middle section and said middle section fits into said stern section.

6. The boat according to claim 1 for sailing, said hull further comprising:

mast support means for supporting a mast;

centerboard support means for supporting a centerboard; and rudder support means for supporting a rudder, said mast, centerboard and rudder support means positioned along said centerline with each attached to at least one of said port and starboard portions.

7. The boat according to claim 1, in which each said starboard and port portion is provided with an upstanding wall member at each margin that is adjacent an adjoining portion, all the wall members of a portion being joined together with said at least one rigid side of said portion in water-tight connection, said wall portions cooperating with said fastening means for securely joining said portions and sections together in said open condition.

8. The boat according to claim 7 further comprising:

a connecting member having a horizontal member joined to four vertical members dependent therefrom, said connecting member arranged for resting atop a junction of four of said portions with each of said vertical members arranged to engage an angle formed by a junction of one said upstanding wall member with another said upstanding wall member of the same portion.

9. The boat according to claim 8, in which said connecting member is provided with a seat on said horizontal member.

10. A portable foldable and nestable boat capable of being readily converted between a rigid boat configuration for operation and a compact package configuration for storage and transport, said boat comprising:

A) a boat hull having, in said boat configuration, a transom, a bottom, a bow, rigid sides, a substantial length along a centerline, and a width that is less than said length, said hull separable into two transverse sections;

B) a foldable forward section including said bow, said forward section comprising a port bow portion and a starboard bow portion hingedly connected together by hinge means having a common pivot axis extending along said centerline for folding said bow portions together to thereby reduce the overall width thereof in said package configuration;

C) a foldable rear section including said transom, said rear section comprising a port stern portion and a starboard stern portion hingedly connected together by hinge means having a common pivot axis extending along said centerline for folding said bow portions together to thereby reduce the overall width thereof in said package configuration;

D) said forward and rear sections being nestable, one within the other when in folded condition to thereby provide a compact package configuration having substantially less width and length than said boat configuration for enhanced storage and transport; and E) securing means for securing said portions and sections to one another in unfolded condition with water-tight connection to provide a rigid, water-tight boat configuration.

11. The boat according to claim 10, in which each said bow portion includes a bottom portion having a periphery from which extend upward a bow piece, a side piece and two bulkheads joined to one another and to said bottom portion in watertight connection, defining thereby a closed, water-tight periphery; and each said stern portion includes a bottom portion having a periphery from which extend upward a transom piece, a side piece and two bulkheads joined to one another and to said bottom portion in water-tight connection, defining thereby a closed, water-tight periphery.

12. The boat according to claim 11, in which said bulkheads are arranged for abutting relationship with corresponding bulkheads of adjacent portions for secure releasable connection thereto into said rigid boat configuration.

13. A portable foldable and nestable boat capable of being readily converted between a rigid boat configuration for operation and a compact package configuration for storage and transport, said boat comprising:

A) a boat hull having, in said boat configuration, a transom, a bottom, rigid sides, a substantial length along a centerline, and a width that is less than said length, said hull being separable into at least three transverse sections;

B) a foldable forward section including said bow, said forward section comprising a port bow portion and a starboard bow portion hingedly connected together by hinge means having a common pivot axis extending along said centerline for folding said bow portions together to thereby reduce the overall width thereof in said package configuration;

C) a foldable rear section including said transom, said rear section comprising a port stern portion and a starboard stern portion hingedly connected together by hinge means having a common pivot axis extending along said centerline for folding said stern portions together to thereby reduce the overall width thereof in said package configuration;

D) at least one foldable intermediate section positionable between said rear section and said forward section, each said intermediate section comprising a port intermediate portion and a starboard intermediate portion hingedly connected together by hinge means having a common pivot axis extending along said centerline for folding said intermediate portions together to thereby reduce the overall width thereof in said package configuration;

E) said forward, intermediate, and rear sections being nestable, one within the other when in folded condition to thereby provide a compact package configuration having substantially less width and length than said boat configuration for enhanced storage and transport; and F) securing means for securing said portions and sections to one another in unfolded condition with water-tight connection to provide a rigid, water-tight boat configuration.

14. The boat according to claim 13, in which each said bow portion includes a bottom portion having a periphery from which extend upward a bow piece, a side piece and two bulkheads joined to one another and to said bottom piece in water-tight connection defining thereby a closed, water-tight periphery; each said stern portion includes a bottom portion having a periphery from which extend upward a transom piece, a side piece and two bulkheads joined to one another and to said bottom portion in water-tight connection, defining thereby a closed, water-tight periphery; and each said intermediate portion includes a bottom portion having a periphery from which extend upward a side piece and three bulkheads joined to one another and to said bottom portion in water-tight connection, defining thereby a closed, water-tight periphery.

15. The boat according to claim 14, in which said bulkheads are arranged for abutting relationship with corresponding bulkheads of adjacent portions for secure releasable connection thereto into said rigid boat configuration.

* * * * *